US009951406B2

(12) United States Patent
Lass et al.

(10) Patent No.: US 9,951,406 B2
(45) Date of Patent: Apr. 24, 2018

(54) ALLOY WITH SELECTED ELECTRICAL CONDUCTIVITY AND ATOMIC DISORDER, PROCESS FOR MAKING AND USING SAME

(71) Applicants: NATIONAL INSTITUTE OF STANDARDS AND TECHNOLOGY, Gaithersburg, MD (US); Tony Ying, Washington, DC (US)

(72) Inventors: Eric A. Lass, Montgomery Village, MD (US); Mark R. Stoudt, Germantown, MD (US); Carelyn Campbell, Germantown, MD (US); Tsineng Tony Ying, Silver Spring, MD (US)

(73) Assignees: THE UNITED STATES OF AMERICA, AS REPRESENTED BY THE SECRETARY OF COMMERCE, Washington, DC (US); THE UNITED STATES OF AMERICA, AS REPRESENTED BY THE DEPARMENT OF THE TREASURY, Washington, DC (US)

( * ) Notice: Subject to any disclaimer, the term of this patent is extended or adjusted under 35 U.S.C. 154(b) by 229 days.

(21) Appl. No.: 14/940,199

(22) Filed: Nov. 13, 2015

(65) Prior Publication Data

US 2016/0068940 A1 Mar. 10, 2016

Related U.S. Application Data

(60) Provisional application No. 62/081,167, filed on Nov. 18, 2014.

(51) Int. Cl.

| | |
|---|---|
| ***C22F 1/08*** | (2006.01) |
| ***B22D 21/02*** | (2006.01) |
| ***C22C 9/04*** | (2006.01) |
| ***C22C 1/02*** | (2006.01) |

(52) U.S. Cl.
CPC ..... *C22F 1/08* (2013.01); *C22C 1/02* (2013.01); *C22C 9/04* (2013.01)

(58) Field of Classification Search
CPC .... C22C 1/02; C22C 9/04; C22F 1/08; B22D 21/025
See application file for complete search history.

(56) References Cited

U.S. PATENT DOCUMENTS

| | | | | |
|---|---|---|---|---|
| 3,640,781 A * | 2/1972 | Ansuini | ..... | C22C 9/04 148/677 |
| 2013/0189540 A1* | 7/2013 | McDaniel | ..... | C22C 9/04 428/675 |

OTHER PUBLICATIONS

Commercial copper alloy C77000, Olin Brass, Data sheet, 2013.

* cited by examiner

*Primary Examiner* — Jenny R Wu
(74) *Attorney, Agent, or Firm* — Toby D. Hain

(57) ABSTRACT

A primary alloy includes: nickel; copper; zinc; an electrical conductivity from 5.2% International Annealed Copper Standard (IACS) to 5.6% IACS measured in accordance with ASTM E1004-09 (2009); and a disordered crystalline phase wherein atoms of the nickel, cooper, and zinc are randomly arranged in the disordered crystalline phase at room temperature in a post-annealed state. A process for making the primary alloy includes heating a secondary alloy to a first temperature that is greater than or equal to an annealing temperature to form an annealing alloy, the secondary alloy including a secondary phase; and quenching, by cooling the annealing alloy from the first temperature to a second temperature that is less than the annealing temperature, under a condition effective to form the primary alloy including the disordered crystalline phase, wherein the disordered crystalline phase is different than the secondary phase of the secondary alloy.

13 Claims, 4 Drawing Sheets

ALLOY WITH SELECTED ELECTRICAL CONDUCTIVITY AND ATOMIC DISORDER, PROCESS FOR MAKING AND USING SAME

CROSS REFERENCE TO RELATED APPLICATIONS

This application claims the benefit of U.S. Provisional Patent Application Ser. No. 62/081,167 filed Nov. 18, 2014, the disclosure of which is incorporated herein by reference in its entirety.

STATEMENT REGARDING FEDERALLY SPONSORED RESEARCH

This invention was made with United States government support from the National Institute of Standards and Technology. The government has certain rights in the invention.

BRIEF DESCRIPTION

Disclosed is a primary alloy comprising: nickel; copper; zinc; an electrical conductivity from 5.2% International Annealed Copper Standard (IACS) to 5.6% IACS measured in accordance with ASTM E1004-09 (2009); and a disordered crystalline phase wherein atoms of the nickel, cooper, and zinc are randomly arranged in the disordered crystalline phase at room temperature in a post-annealed state.

Further disclosed is a process for making the primary alloy, the process comprising: heating a secondary alloy to a first temperature that is greater than or equal to an annealing temperature to form an annealing alloy, the secondary alloy comprising a secondary phase; and quenching, by cooling the annealing alloy from the first temperature to a second temperature that is less than the annealing temperature, under a condition effective to form the primary alloy comprising the disordered crystalline phase, wherein the disordered crystalline phase is different than the secondary phase of the secondary alloy.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
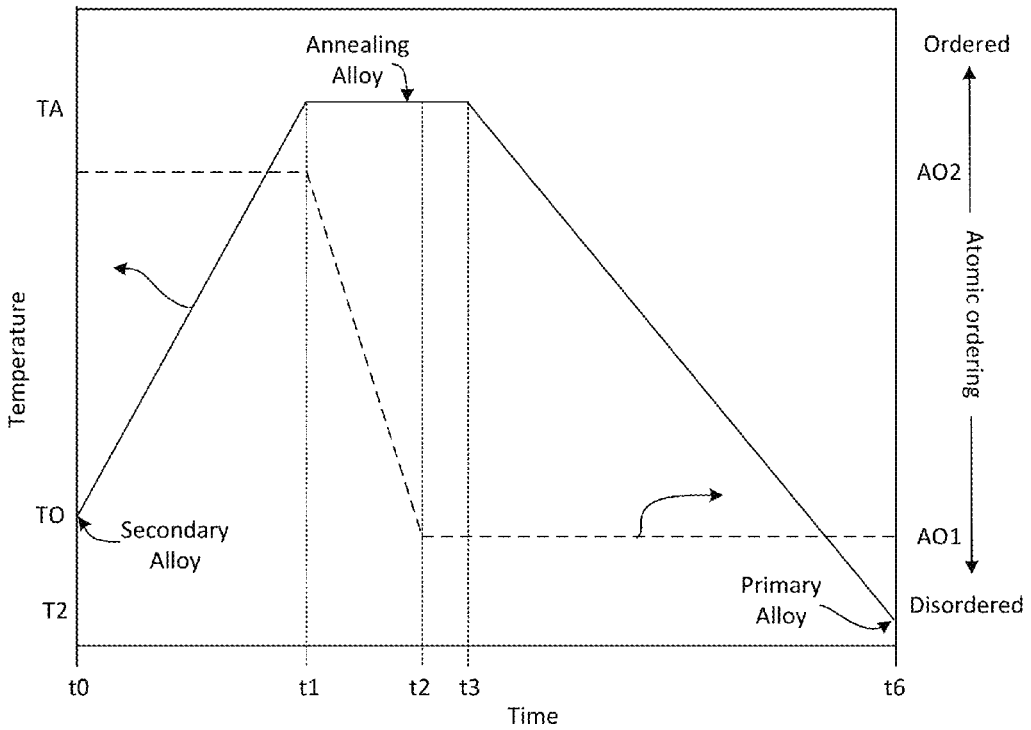
FIG. 1 shows a graph of temperature versus time for forming a primary alloy that includes a disordered crystalline phase and selected electrical conductivity.

A detailed description of one or more embodiments is presented herein by way of exemplification and not limitation.

It has been discovered that a primary alloy herein has beneficial electrical, chemical, and physical properties suitable as a substitute for a cupronickel alloy for coins used in commerce, particularly coins in the United States that include the cupronickel alloy.

In an embodiment, the primary alloy includes a plurality of transition metal elements, e.g., nickel, copper, zinc, manganese, iron, or the like. The primary alloy has a property effective for use of the primary alloy in currency. In a particular embodiment, the primary alloy includes nickel, copper, and zinc in amount effective such that the primary alloy has an electrical conductivity compatible with disposition in a coin that is compatible with a coin vending apparatus, a coin counter, or a coin identification machine.

In some embodiments, the primary alloy has an electrical conductivity from 5.2% International Annealed Copper Standard (IACS) to 5.6% IACS measured in accordance with ASTM E1004-09 (2009). According to an embodiment, the primary alloy has a disordered crystalline phase wherein atoms of the nickel, cooper, and zinc are randomly arranged in the disordered crystalline phase at room temperature in a post-annealed state.

Materials used in a manufacture of the primary alloy can contain a low level of an impurity such as a metal-, carbon-, or nitrogen-containing impurity. Such impurity can be present in the primary alloy described herein, provided that the impurity is not present in an amount that significantly adversely affects the desired properties of the primary alloy, in particular the electrical conductivity of the primary alloy. Impurities may be present in the primary alloy in a minor amount due to, e.g., the inherent properties of nickel, copper, zinc, iron, or manganese vanadium or may be present due, e.g., to leaching from contact with manufacturing equipment or uptake during processing of the primary alloy.

The primary alloy contains nickel in an amount from 18 weight percent (wt. %) to 21 wt. %, specifically 18 wt. % to 20 wt. %, and more specifically 19 wt. % to 21 wt. %, based on a total weight of the primary alloy. In an embodiment, the primary alloy contains 19.3 wt. % nickel, based on a total weight of the primary alloy.

The primary alloy contains zinc in an amount from 24 wt. % to 28 wt. %, specifically 25 wt. % to 27 wt. %, and more specifically 25 wt. % to 26 wt. %, based on a total weight of the primary alloy. In an embodiment, the primary alloy contains 26.0 wt. % zinc, based on a total weight of the primary alloy.

The primary alloy contains copper in an amount from 45 wt. % to 68 wt. %, specifically 50 wt. % to 60 wt. %, and more specifically 52 wt. % to 58 wt. %, based on a total weight of the primary alloy. In an embodiment, primary alloy contains 54.3 wt. % copper, based on a total weight of the primary alloy.

The primary alloy can contain manganese in an amount from 0 wt. % to 1 wt. %, specifically 0.3 wt. % to 0.6 wt. %. In an embodiment, primary alloy contains 0.4 wt. % manganese, based on a total weight of the primary alloy.

The primary alloy can contain iron in an amount from 0 wt. % to 1 wt. %, specifically less than or equal to 0.2 wt. %, based on a total weight of the primary alloy. In an embodiment, the primary alloy contains 0 wt. % iron, based on a total weight of the primary alloy.

The primary alloy can contain lead in an amount from 0 wt. % to 1 wt. %, specifically less than 0.2 wt. %, based on a total weight of the primary alloy. In an embodiment, primary alloy contains 0.05 wt. % lead, based on a total weight of the primary alloy.

According to an embodiment, the primary alloy contains nickel in an amount from 18 wt. % to 21 wt. %, zinc in an amount from 24 wt. % to 28 wt. %, manganese in an amount of 0.3 wt. % to 0.6 wt. %, based on the total weight of the primary alloy, with the balance of the total weight being copper. That is, copper is present in an amount as a balance of the total weight of the primary alloy.

According to an embodiment, the primary alloy contains nickel in an amount from 18 wt. % to 21 wt. %, zinc in an amount from 24 wt. % to 28 wt. %, and copper in an amount from 45 wt. % to 68 wt. %, based on the total weight of the primary alloy.

In an embodiment, the primary alloy contains nickel in an amount from 18 wt. % to 21 wt. %, zinc in an amount from 24 wt. % to 28 wt. %, and manganese in an amount from 0 wt. % to 1 wt. %, based on the total weight of the primary alloy, with the balance of the total weight being copper.

In an embodiment, the primary alloy contains nickel in an amount from 18 wt. % to 21 wt. %, zinc in an amount from 24 wt. % to 28 wt. %, and iron in an amount from 0 wt. % to 0.2 wt. %, based on the total weight of the primary alloy, with the balance of the total weight being copper.

In an embodiment, the primary alloy contains nickel in an amount from 18 wt. % to 21 wt. %, zinc in an amount from 24 wt. % to 28 wt. %, manganese in an amount from 0 wt. % to 1 wt. %, and iron in an amount from 0 wt. % to 0.2 wt. %, based on the total weight of the primary alloy, with the balance of the total weight being copper.

In an embodiment, the primary alloy contains nickel in an amount from 18 wt. % to 21 wt. %, zinc in an amount from 24 wt. % to 28 wt. %, manganese in an amount from 0 wt. % to 1 wt. %, and copper in an amount from 45 wt. % to 68 wt. %, based on the total weight of the primary alloy.

In an embodiment, the primary alloy contains nickel in an amount from 18 wt. % to 21 wt. %, zinc in an amount from 24 wt. % to 28 wt. %, iron in an amount from 0 wt. % to 0.2 wt. %, and copper in an amount from 45 wt. % to 68 wt. %, based on the total weight of the primary alloy.

In an embodiment, the primary alloy contains nickel in an amount from 18 wt. % to 21 wt. %, zinc in an amount from 24 wt. % to 28 wt. %, manganese in an amount from 0 wt. % to 1 wt. %, iron in an amount from 0 wt. % to 0.2 wt. %, and copper in an amount from 45 wt. % to 68 wt. %, based on the total weight of the primary alloy.

In a particular embodiment, the primary alloy includes 19.3 wt. % Ni, 26 wt. %, Zn, 0.4 wt. % Mn, and Cu, based on a total weight of the primary alloy.

In a particular embodiment, the primary alloy includes 19.3 wt. % Ni, 26 wt. %, Zn, 0.4 wt. % Mn, and 54.3 wt. % Cu, based on the total weight of the primary alloy.

According to an embodiment, the primary alloy is referred to as C77D and includes Ni, Cu, and Zn that are present in an amount from 18 to 21 wt. % Ni, from 24 to 28 wt. % Zn, up to 1.0 wt. % Mn, less than 0.2 wt. % Fe, less than 0.1 wt. % of the impurity, and Cu, based on a total weight of the primary alloy, with the balance of the total weight being copper.

The primary alloy can contain less than 1 weight percent (wt. %), less than 0.5 wt. %, or less than 0.1 wt. % of materials (e.g., the impurity) other than the nickel, copper, and zinc, based on the total weight of the primary alloy.

An exemplary composition of the primary alloy is shown in Table 1.

TABLE 1

| Element | Amount (wt. %, based on total weight of primary alloy) |
|---|---|
| Ni | 18.5-20.1 |
| Zn | 24-28 |
| Mn | 0.3-0.6 |
| Fe | <0.2 |
| Cu | balance |

According to an embodiment, the primary alloy can include a nominal composition of Cu- 19.3Ni- 26Zn- 0.4Mn.

In an embodiment, selected amounts of the nickel, copper, and zinc are combined at a temperature effective to produce a melt of the metals. A pure metal of the nickel, copper, and zinc can be combined and then melted, or a melt of the copper is combined with the nickel or zinc. Alternatively, the secondary alloy can be prepared by depositing, implanting, or doping the nickel, copper, or zinc with manganese, iron, lead, or the impurity.

According to an embodiment, a process for making the primary alloy includes melting a composition comprising the nickel, copper, and zinc to form a molten alloy; and casting the molten alloy to form a secondary alloy in a solid state comprising a secondary phase, wherein the secondary phase is different from the disordered crystalline phase of the primary alloy. The process can further include subjecting the secondary alloy to thermo-mechanical processing to form an article such as a sheet or ingot. Exemplary, thermo-mechanical processing includes rolling, forging, and the like.

Melting the composition occurs, e.g., at a temperature greater than or equal to a melting temperature of the nickel, copper, or zinc. Further, casting includes decreasing the temperature of the molten alloy below the melting point to form the secondary alloy. Casting can include cooling a container in which the molten alloy is disposed during melting. In some embodiments, casting includes disposing the molten alloy in a mold to form the secondary alloy with secondary phase at a temperature less than the melting point of the secondary alloy. Here, the cooling rate during formation of the secondary phase is not sufficient to form the primary alloy in the disordered crystalline phase.

With the secondary alloy formed, the process includes heating the secondary alloy to a first temperature that is greater than or equal to an annealing temperature to form an annealing alloy; and quenching, by cooling the annealing alloy from the first temperature to a second temperature that is less than the annealing temperature, under a condition effective to form the primary alloy that includes the disordered crystalline phase. Again, the disordered crystalline phase is different from the secondary phase of the secondary alloy.

In an embodiment, a process for making the primary alloy includes providing the secondary alloy (e.g., from an external source of the secondary alloy), wherein the secondary alloy includes a selected amount of the nickel, copper, and zinc and which has the secondary phase; subjecting the secondary alloy to thermo-mechanical processing to form an article (e.g., a sheet) of the secondary alloy; subjecting the article to the first temperature that is greater than or equal to the annealing temperature of the secondary alloy to form the annealing alloy; quenching the annealing alloy at a cooling rate to produce the primary alloy having the disordered crystalline phase.

According to an embodiment, the thermo-mechanical processing includes subjecting the secondary alloy to a compressive force or tensile force effective to form a sheet of the secondary alloy. Thermo-mechanical processing conditions can include operating at a temperature from 20° C. to 800° C., e.g., operating at room temperature; a pressure from 120 MPa to 700 MPa; or a combination thereof, wherein based on a tensile stress strain curve, 120 MPa being the yield stress and 700 being above an ultimate tensile stress.

The annealing temperature is selected such that the secondary alloy is subjected to heat that is sufficient to transform the secondary phase of the secondary alloy to a substantially disordered phase of the annealing alloy above the annealing temperature as the annealing alloy forms from the secondary alloy. Here, the annealing alloy is eventually transformed into the primary alloy having the disordered crystalline phase as the annealing alloy is cooled below the annealing temperature. The annealing temperature can depend on the elemental composition of the secondary alloy and can be from 700° to 800° C., specifically from 725° C. to 775° C. In an embodiment, the condition for quenching the temperature to less than the annealing temperature includes a cooling rate that is greater than or equal to that cooling rate provided by air cooling from the first temperature to the second temperature. In a certain embodiment, the cooling rate that is greater than or equal to the cooling rate of water quenching from the first temperature to the second temperature to form the primary alloy from the secondary alloy. In some embodiments, it is contemplated that the cooling rate is from 1 degrees Celsius per second (° C./s) to 1000° C./s, specifically from greater than or equal to 10° C./s. It is contemplated that the cooling rate can be from $10^{4}$° C./s to $10^{5}$° C./s for certain articles that include the primary alloy.

With reference to FIG. 1, as used herein, the term "cooling rate" refers to a rate of a decrease in temperature of the annealing alloy from annealing temperature TA to second temperature T2 at which the primary alloy is formed. FIG. 1 shows a graph of temperature (left-hand axis for solid curve) and atomic ordering (right-hand axis for dashed curve) versus time for forming the primary alloy from the secondary alloy via the annealing alloy.

At time t0, the secondary alloy is at temperature T0 with second atomic ordering AO2 corresponding to the secondary phase. From time t0 to time t1, the secondary alloy is heated from temperature T0 to annealing temperature TA to form the annealing alloy. At annealing temperature TA during time t1 to time t2, the annealing alloy is formed, and the atomic ordering changes from second atomic ordering AO2 to first atomic ordering AO1. From time t3 to time t6, the temperature decreases from annealing temperature TA to second temperature T2 as the primary alloy is formed having the disordered crystalline phase.

Figure 2:
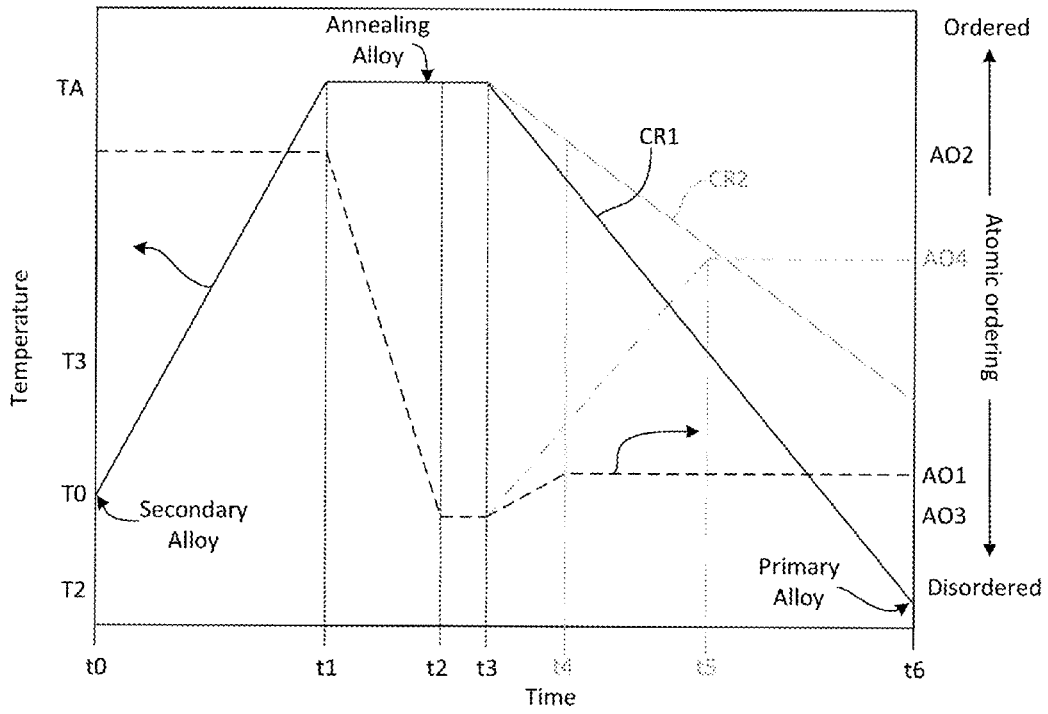
FIG. 2 shows a graph of temperature versus time for forming the primary alloy that includes the disordered crystalline phase and selected electrical conductivity.

In some embodiments, the annealing alloy and the primary alloy have a same atomic ordering, e.g., first atomic ordering AO1. In certain embodiments, the primary alloy and the annealing alloy have a different atomic ordering as shown in FIG. 2, wherein the annealing alloy has atomic ordering AO3 from time t2 to time t3, and the primary alloy has first atomic ordering AO1 for first cooling rate CR1. Here, cooling during time t3 to time t4 occurs in which atomic ordering changes from atomic ordering AO3 at time t3 to atomic ordering AO1 at time t4 at first cooling rate CR1. Thereafter, from time t4 to time t6 the primary alloy is formed and has atomic ordering AO1, wherein the secondary alloy at time t0 has a greater degree of atomic ordering AO2 than does primary alloy (with atomic ordering AO1) and also the annealing alloy (with atomic ordering AO3).

Additionally, as shown in FIG. 2, a rate of cooling from the annealing alloy to the primary alloy during time t3 to time t6 governs the atomic ordering of the primary alloy as well as other properties such as the electrical conductivity or hardness of the primary alloy. With reference to FIG. 2, first cooling rate CR1 is greater than second cooling rate CR2. For second cooling rate CR2, quenching the annealing alloy starts at time t3 with the annealing alloy having atomic ordering AO3, which changes to atomic ordering AO4 at time t5 such that the primary alloy is formed with atomic ordering AO4. Here, the secondary alloy at time t0 has a greater degree of atomic ordering AO2 than does the primary alloy (with atomic ordering AO4 at time t6) and also the annealing alloy (with atomic ordering AO3). Due to the cooling rate, e.g., first cooling rate CR1 or second cooling rate CR2 and the like, the atomic ordering in the primary alloy formed from the secondary alloy via the annealing alloy can be selected to have a tailored atomic ordering, electrical conductivity, or other property such as hardness.

It is contemplated that quenching includes exposing the annealing alloy at the first temperature (which is greater than or equal to annealing temperature TA) to a fluid to rapidly cool the annealing alloy from the first temperature to below annealing temperature TA of the primary alloy. In this manner, the primary alloy is formed with the disordered crystalline phase having a selected atomic ordering. Here, the fluid can be a gas, liquid, or a combination thereof. Exemplary gases include air (including individual components of air (e.g., $N_2$, $O_2$, Ar, $H_2O$, and the like)), noble gases, polyatomic gases (e.g., H2, CO2, and the like), and the like. Exemplary liquids include water, betaine, an oil, and the like. The heat capacity of the fluid can be high such that the fluid can receive a considerable amount of heat from the annealing alloy or primary alloy during quenching and provide a high quenching rate. Similarly, a volume of the fluid used can be effective to provide a low temperature, heat sink effective to quench rapidly the annealing alloy or primary alloy such that the primary alloy attains the disordered crystalline phase. The fluid can be selected to provide a volume or heat capacity to provide an isothermal environment at a selected temperature (e.g., room temperature, or a temperature such as from −20° C. to 100° C.) to which the annealing alloy or primary alloy is subjected so that the temperature of the annealing alloy can be decreased rapidly from the first temperature (greater than the annealing temperature) to the second temperature (less than the annealing temperature) to provide the primary alloy prepared with the disordered crystalline phase and the selected electrical conductivity.

The secondary alloy can include the same elemental composition as the primary alloy. Without wishing to be bound by theory, due to increasing the secondary alloy to the first temperature (which is greater than the annealing temperature of the material) to form the annealing alloy, the atoms in the annealing alloy become arranged in a disordered phase such as a face-centered cubic phase at the first temperature. Rapidly quenching the annealing alloy from the first temperature (greater than the annealing temperature) to the second temperature (less than the annealing temperature) does not provide enough time for the atoms to rearrange into an ordered crystalline phase. As a result, the atoms maintain the disordered crystalline phase at the second temperature (and cooler temperatures thereof) in the primary alloy. Besides the secondary alloy having a different phase from the primary alloy, the secondary alloy can include a first electrical conductivity that is different from the electrical conductivity of the primary alloy. Moreover, the secondary alloy can include a first hardness that is different from a hardness of the primary alloy.

In an embodiment, the secondary alloy is subjected to annealing at the first temperature (which is greater than annealing temperature TA of the secondary alloy) to form the annealing alloy. At the first temperature, the annealing alloy has a single phase that has a face-centered cubic (FCC) microstructure. In some embodiments, the first temperature is, e.g., greater than 450° C., and the annealing alloy can be held at or above annealing temperature TA for a selected time, e.g., from a few minutes to several hours. Processing the annealing alloy includes cooling the annealing alloy rapidly from the annealing temperature to approximately room temperature to form the primary alloy in the primary phase. Cooling can occur by fast quenching (e.g., water quenching) or another method with a selected cooling rate to provide the primary alloy in the primary phase. It should be appreciated that the elemental composition of the secondary alloy and the primary alloy are the same, but the first electrical conductivity of the primary alloy is different from the second electrical conductivity of the secondary alloy.

In certain embodiments, an electrical conductivity or mechanical property of the primary alloy is selectively tailored or tuned by providing a rate of quenching the annealing alloy from annealing temperature TA to control a degree of atomic-level short-range ordering from a high-temperature disordered FCC crystal phase in the annealing alloy to an ordered phase of the primary phase of the primary alloy obtained by the selected quenching process, wherein the primary phase of the primary alloy is disordered compared to the secondary phase of the secondary alloy. It is contemplated that a faster cooling rate provides decreased ordering with the primary alloy having a higher conductivity and lower hardness mechanical property compared with the secondary alloy. It is further contemplated that a slower cooling rate provides increased ordering on an atomic level and concomitant electrical conductivity (e.g., lower electrical conductivity) and mechanical property (e.g., higher hardness) of the primary alloy.

Figure 3:
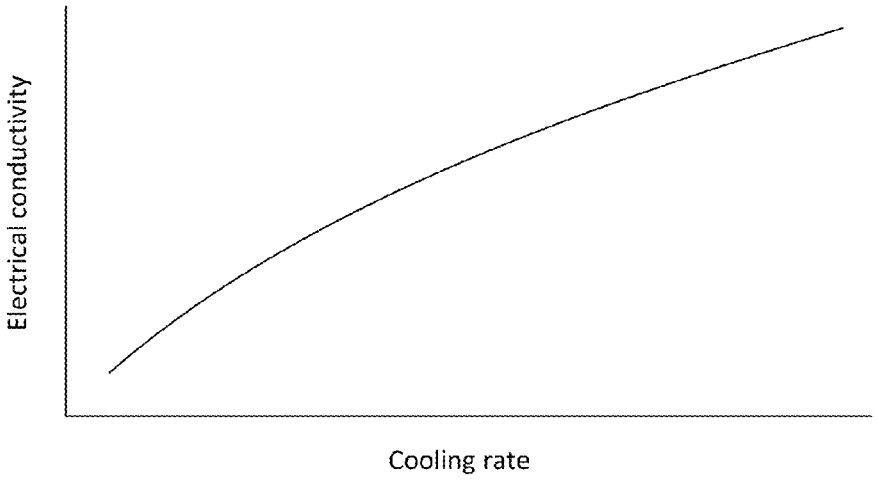
FIG. 3 shows a graph of electrical conductivity versus cooling rate for the primary alloy.
Figure 4:
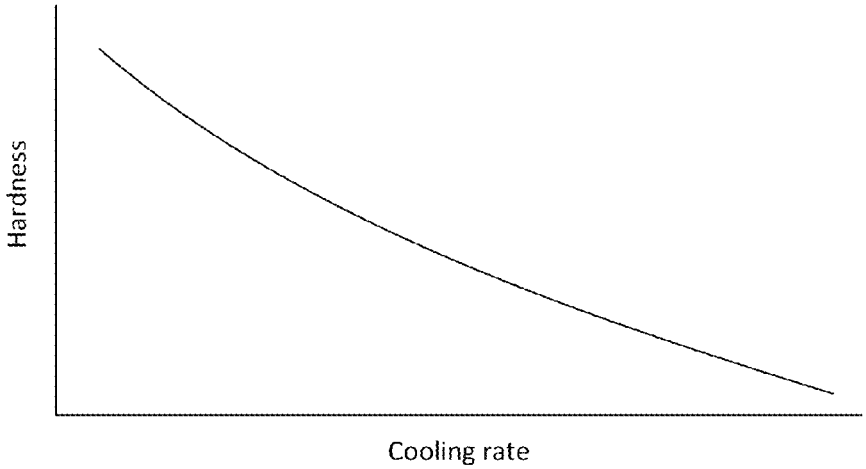
FIG. 4 shows a graph of hardness versus cooling rate for the primary alloy.

FIG. 3 shows a graph of electrical conductivity of the primary alloy versus cooling rate of the annealing alloy during formation of the primary alloy from the annealing alloy. Here, the electrical conductivity of the primary alloy increases as the cooling rate of the annealing alloy from the first temperature to the second temperature increases. For the hardness of the primary alloy, FIG. 4 shows a graph of hardness of the primary alloy versus cooling rate of the annealing alloy during formation of the primary alloy from the annealing alloy. Here, the hardness of the primary alloy decreases as the cooling rate (of the annealing alloy) from the first temperature to the second temperature increases.

Figure 5:
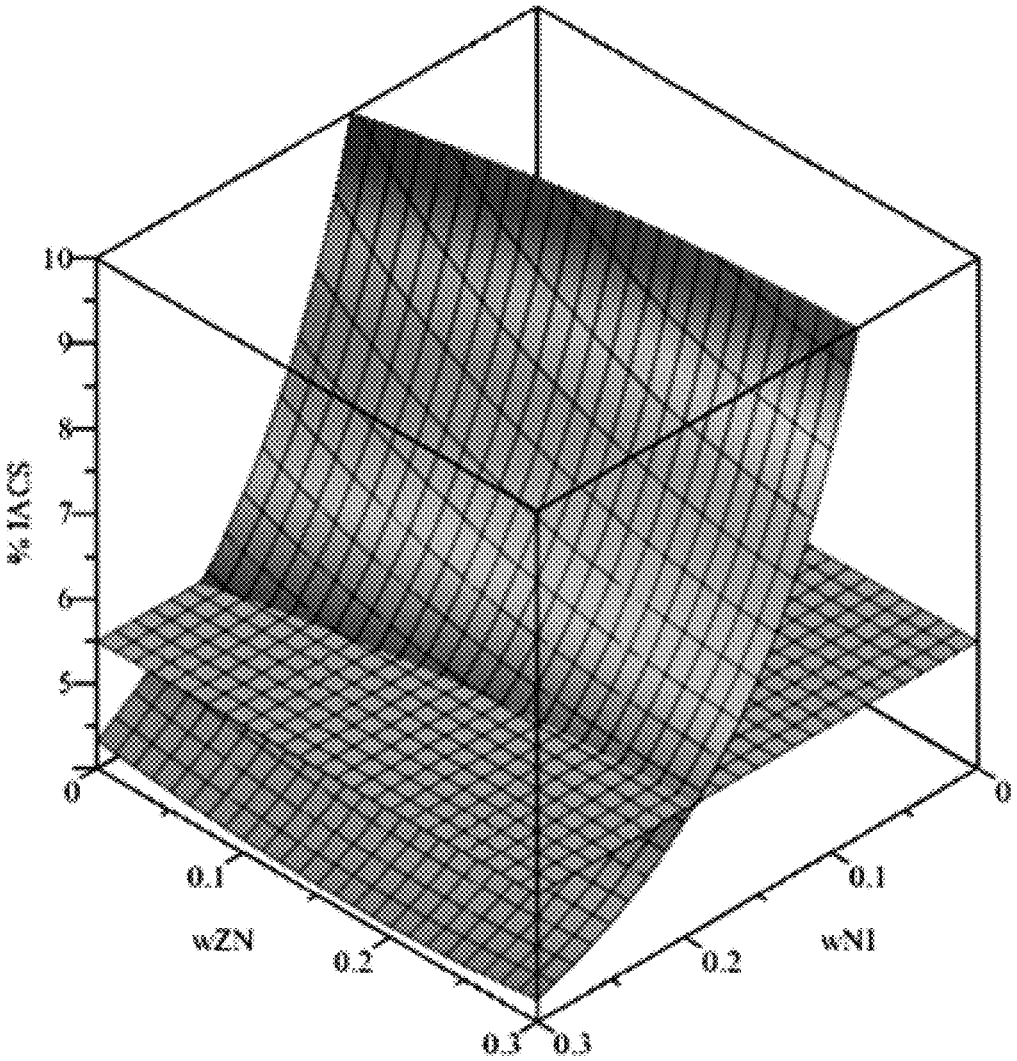
FIG. 5 shows a graph of electrical conductivity versus amount of zinc and nickel for various alloys.

In an embodiment, a process for forming the primary alloy includes determining (e.g., making a predictive model) a composition of the primary alloy based on electrical conductivity σ of the primary alloy, wherein data used in the model can be empirical or theoretical data. In an embodiment, the primary alloy includes Cu—Ni—Zn, and FIG. 5 shows a graph of electrical conductivity versus an amount of Zn and an amount of Ni for a calculated electrical conductivity σ of the primary alloy (formed from the annealing alloy) on the amount of Ni (by weight percentage (wt. %)) or Zn, wherein an amount of Cu was wt. %, based on a total weight of the primary alloy. The primary alloy here has a composition that is nominally a ternary Cu—Ni—Zn composition of a commercially available alloy having unified numbering system UNS C77000 (ASTM International manages the UNS jointly with SAE International), referred to herein as C77000 alloy. According to the model, an amount of Ni in the primary alloy effect the electrical conductivity σ of the primary alloy than an amount of Zn. In FIG. 5, the plane is a 5.5% IACS (International Annealed Copper Standard (IACS) measured in accordance with ASTM E1004-09 (2009)) electrical conductivity target for US coinage applications. The slope of the curve along the Ni-content axis shows effect of Ni amount on electrical conductivity compared to the amount of Zn and provides a range of compositional amounts of Ni and Zn in some embodiments of the primary alloy, depending on an amount of Cu present in the primary alloy.

The process also includes determining (e.g., from the model) an electrical conductivity dependence on an amount of Ni, Zn, Cu, Mn, Fe, Pb, and the like, or a combination thereof.

Constructing the model includes: collecting experimental data for electrical resistivity (or electrical conductivity) for the elements in the primary alloy (e.g., Cu, Ni, Zn, Mn, and the like); collecting experimental data for electrical resistivity (or electrical conductivity) for binary alloy systems that include binary combinations of elements in the primary alloy (e.g., binary alloys include Cu—Ni, Cu—Zn, Cu—Mn, Ni—Zn, Ni—Mn, Zn—Mn, and the like); collecting experimental data of electrical resistivity (or electrical conductivity) for the ternary alloy systems that include ternary combinations of elements in the primary alloy (e.g., ternary alloys include Cu—Ni—Zn, Cu—Ni—Mn, Cu—Zn—Mn, Ni—Zn—Mn, and the like); and fitting a function (e.g., a polynomial function) to the collected data, wherein the function is relation between the electrical resistivity and an independent composition variable. It is contemplated that the functional relationship is analogous, e.g., to the Calphad method for computational thermodynamics.

A process for producing the primary alloy includes heating the secondary alloy (e.g., (e.g., a rolled sheet of the secondary alloy) to the first temperature (e.g., from 700° C. to 800° C.); holding the temperature at the first temperature for a selected time (e.g., up to 60 min) to form the annealing alloy; and cooling the annealing alloy by quenching (e.g., water quenching) to the second temperature (e.g., a room temperature) a selected cooling rate to produce the primary alloy, wherein the primary alloy has a selected property. The selected property includes an electrical conductivity from 5.3% IACS to 5.6% IACS as measured with an eddy current method at 240 kHz in accordance with ASTM E1004-09 (2009). In some embodiments, the electrical conductivity of the primary alloy is substantially equivalent to an electrical conductivity of UNS C71300 alloy. In an embodiment, the quenching rate is effective to produce the primary alloy with the electrical conductivity substantially equivalent to an electrical conductivity of the Cu-Ni binary alloy UNS C71300 alloy. Moreover, the electrical conductivity as measured at 60 kHz, 120 kHz, and 480 kHz for the primary alloy is substantially equivalent to the UNS C71300 alloy.

In an embodiment, a coin blank includes the primary alloy, wherein an electrical conductivity of the coin blank is substantially equivalent to the electrical conductivity of UNS C71300 alloy. According to an embodiment, a process for making the coin blank includes punching coin blanks from a material sheet; annealing the blanks at a selected annealing temperature or a selected annealing time, quenching the blanks at the annealing temperature for a selected time in a fluid bath (e.g., a water bath); subjected the blanks to removal of oxide scale formed during annealing (e.g., by pickling the blanks); disposing on an antitarnish coating on the blanks; upsetting the blank by deforming the blank edges to form a coin rim; striking a plurality of the coins. The coins can be packaged (e.g., bagged) and shipped. In some embodiments, a plurality of coins is made from the coin, and the coins have an electrical conductivity that is substantially identical to that of the primary alloy. In an embodiment, the coins have an acceptance rate of 100% with coin vending machines, coin counters, coin detectors, and the like.

The primary alloy has beneficial, advantageous, and unexpected properties. A color of the primary alloy is silvery-white, wherein the color has an a*value that is less than 2.5 and a b*value that is less than 10.0, measured in accordance on the Commission of Illumination L*a*b* color space. The electrical conductivity of the primary alloy is from 5% IACS to 6% IACS, as determined by an eddy current conductivity meter operating at a frequency from 60 to 480 kHz in accordance with ASTM E1004-09 (2009). In an embodiment, the electrical conductivity of the primary alloy is from 5% IACS to 5.45% IACS. In a certain embodiment, the electrical conductivity of the primary alloy is within ±0.2% IACS of the electrical conductivity of USN C71300 alloy. According to an embodiment, the electrical conductivity of the primary alloy is effective such that the coin includes the primary alloy is accepted by coin-operated vending machines in the United States. In a particular embodiment, the electrical conductivity of the primary alloy is within ±0.2% IACS for coins that are accepted by coin-operated vending machines in the United States.

The primary alloy has a mechanical property such that the primary alloy can be subjected to mechanical modification such as stamping, wherein a sheet of the primary alloy is formed into an article such as a coin. The primary alloy can have a yield strength from 120 megapascals (MPA) to 180 MPa. The primary alloy has an initial work hardening coefficient from 0.10 to 0.15, calculated from a tensile stress-strain curve over a strain range from 0.01 to 0.2, using Hollomon's equation for the power law relationship between stress and plastic strain. A corrosion rate of the primary alloy is effective so that the primary alloy is applicable in in a currency application, e.g., in a currency coin used in commerce. The primary alloy has excellent wear resistance such that the primary alloy has a long lifetime of years, e.g., decades. A density of the primary alloy is similar to cupronickel such that a coin that includes the primary alloy has a same mass as a coin that includes cupronickel.

In an embodiment, the primary alloy beneficially has an electrical conductivity such that the primary alloy is a replacement for the USN C71300 alloy used in U.S. coinage applications.

In an embodiment, the primary alloy includes a single phase. In a certain embodiment, the single phase includes face-centered cubic (FCC) arrangement of atoms. Without wishing to be bound by theory, it is believed that when cooling the annealing alloy from the first temperature to the second temperature to form the primary alloy, the annealing alloy has an FCC structure, and an ordering reaction does not occur upon cooling to the second temperature such that the FCC structure is the only phase present in the primary alloy. Even though an ordered phase (referred to as $L1_2$ and $L1_0$ with respect to phases) in ternary Cu—Ni—Zn systems are known to exit, embodiments of the primary alloy do not include the ordered $L1_2$ or $L1_0$ phase. Instead, the primary alloy has the FCC phase substantially so that the primary alloy can replace the UNS 13700 alloy in US coins such as five-cent coin (i.e., 5¢, $0.05 US dollar (USD)).

In an embodiment, the rate at which the annealing alloy is cooled from annealing temperature TA above which the ordering reaction occurs is selectively controlled to produce the primary alloy the single phase disordered crystalline phase and selected electrical conductivity and hardness. Without wishing to be bound by theory, it is believed that the ordering reaction from FCC to $L1_2$ occurs rapidly at a certain cooling rate, and the degree of atomic ordering varies from completely atomically disordered to fully atomically ordered such that the atomic ordering depends on the quenching rate from annealing temperature TA to approximately room temperature. Accordingly, in an embodiment, the cooling rate is selected to be high enough to form selectively the primary alloy from the annealing alloy, wherein the primary alloy includes the disordered crystalline phase in an absence of the $L1_0$ or $L1_2$ phase.

The hardness of the primary alloy is effective such that the primary alloy can be subjected to mechanical deformation to produce an article such as a coin. The hardness can be a Vickers micro hardness from 80 HV02 (HV02 indicates the Vickers hardness number measured with a force of 0.2 kg) to 100 HV02 [units], specifically less than 108 HV02. Mechanical deformation can include bending, stretching, cutting, and the like. In an embodiment, a sheet of the primary alloy is formed and subjected to stamping to form an article such a plurality of coins.

The primary alloy advantageously provides for seamless substitution of current cupronickel alloys used in certain currency, .e.g., coins, e.g., US coins. In a particular embodiment, the primary alloy is a replacement for cupronickel alloy (e.g., USN C71300 alloy) used in production by the United States Mint of five-cent U.S. coins ("nickels").

It has been found that the primary alloy can be used in currency applications due to its physical, chemical, or mechanical property. The primary alloy can be cast or prepared into a selected format by, e.g., a process that includes thermo-mechanically processing (e.g., rolling, forging, and the like).

The primary alloy is a seamless substitution for cupronickel in U.S. coin-making at a cost that is, e.g., 20% less than current cupronickel alloy processing. The electrical conductivity of the primary alloy is substantially identical to the electrical conductivity of cupronickel alloy such that the primary alloy is used as a coin with coin-operated vending machines, coin counters, coin identification machines, and the like.

Advantageously and unexpectedly, the conductivity of the primary alloy is selected such that a coin including the primary alloy is acceptable as currency in a vending machine that accepts the coin. Acceptance of the coin contemplates that an electrical signature (e.g., electrical conductivity) of the coin is equivalent to an electrical signature of currently available coins made with their current material when measured using current coin-sorting technology.

In an embodiment, the primary alloy is used in a variety of applications that use a conductive metal having the electrical conductivity of the primary alloy, e.g., as an electrical contact for an electronic device. An electrical contact formed using the primary alloy can be used such that a first component and a second component are arranged in a spaced apart relation. The primary alloy (or a composition comprising the primary alloy) is disposed between and in physical contact with the first component and the second component to form an electrical path between the first component and the second component. The primary alloy can be in a wide variety of forms to contact the first and the second component. The form may be, for example, a wire, cable, button, coating, and the like.

In an embodiment, the primary alloy is a portion of a conductive contact in a connector, switch, or insert. Examples of the connector are a blade connector, push-on connector, crimp connector, multi-pin connector (e.g., a D-sub connector), bolt connector, set screw connector, lug, wedge connector, bolted connector, compression connector, coaxial connector, wall connector, surface mount technology (SMT) board connector, IPC connector, DIN connector, phone connector, plastic leaded chip carrier (PLCC) socket or surface mount connector, integrated circuit (IC) connector, ball grid array (BGA) connector, staggered pin grid array (SPA) connector, busbar connector, or the like. Switches include, e.g., a circuit breaker, mercury switch, wafer switch, dual-inline package (DIP) switch, reed switch, wall switch, toggle switch, in-line switch, toggle switch, rocker switch, microswitch, rotary switch, and the like. An insert can be, e.g., a transition washer, disc, tab, and the like.

The primary alloy has a number of advantages. The primary alloy has sufficient electrical conductivity to prevent development of an unacceptably high contact resistance. Use of the primary alloy decreases use of precious metal plating of electrical contacts while conserving operational characteristics of such current-carrying contacts. In addition, the primary alloy is manufactured from widely available materials.

The articles and processes herein are illustrated further by the following Example, which is non-limiting.

EXAMPLE

A secondary alloy was produced at NIST and included a composition of 54.3 wt. % Cu, 19.3 wt. % Ni, 26.0 wt. % Zn, and 0.3 wt. % Mn. The secondary alloy had an electrical conductivity and Vickers micro hardness (VHN) that respectively were 5.7% IACS and 245 HV02. The secondary alloy was heated to an annealing temperature of 750° C. for 30 min to form an annealing alloy. The annealing alloy was cooled by quenching into water to form the primary alloy. After cooling the annealing alloy, the primary alloy had an electrical conductivity of 5.4% IACS, a Vickers micro hardness of 103 HV02, a yield strength of 130 MPa, and a strain-to-failure of approximately 50%. An initial work hardening rate of the primary alloy was 0.13 (no units) such that plastic flow during later stamping of the primary alloy was sufficient to produce a coin.

Wear testing of the primary alloy showed a wear rate that was three times lower than USN C71300 alloy. Tests of tarnishing behavior of the primary alloy subjected to 100° C. steam showed that the primary alloy had an improved resistance to color change as compared to C71300 alloy. Electrochemical testing of the primary alloy showed a susceptibility of the primary alloy to localized corrosive attack and de-alloying in sulfate solution. Testing in simulated sweat and wear corrosion results showed less reactivity of the primary alloy in this solution than the C71300 alloy.

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

Reference throughout this specification to "one embodiment," "particular embodiment," "certain embodiment," "an embodiment," or the like means that a particular feature, structure, or characteristic described in connection with the embodiment is included in at least one embodiment. Thus, appearances of these phrases (e.g., "in one embodiment" or "in an embodiment") throughout this specification are not necessarily all referring to the same embodiment, but may. Furthermore, particular features, structures, or characteristics may be combined in any suitable manner, as would be apparent to one of ordinary skill in the art from this disclosure, in one or more embodiments.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

As used herein, "a combination thereof" refers to a combination comprising at least one of the named constituents, components, compounds, or elements, optionally together with one or more of the same class of constituents, components, compounds, or elements.

All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." Further, the conjunction "or" is used to link objects of a list or alternatives and is not disjunctive; rather the elements can be used separately or can be combined together under appropriate circumstances. It should further be noted that the terms "first," "second," "primary," "secondary," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

What is claimed is:

1. A primary alloy comprising:

nickel present in an amount from 18 wt. % to 21 wt. %, based on a total weight of the primary alloy;

copper present in an amount from 45 wt. % to 58 wt. %, based on the total weight of the primary alloy;

zinc present in an amount from 24 wt. % to 28 wt. %, based on the total weight of the primary alloy;

an electrical conductivity from 5.2% International Annealed Copper Standard (IACS) to 5.6% IACS measured in accordance with ASTM E1004-09 (2009); and a disordered crystalline phase wherein atoms of the nickel, cooper, and zinc are randomly arranged in the disordered crystalline phase at room temperature in a post-annealed state; the disordered crystalline phase is a single phase.

2. The primary alloy of claim 1, further comprising manganese, wherein the manganese is present in an amount from 0 wt. % to 1 wt. %, based on a total weight of the primary alloy.

3. The primary alloy of claim 2, further comprising iron, wherein the iron is present in an amount from 0 wt. % to 0.2 wt. %, based on a total weight of the primary alloy.

4. The primary alloy of claim 1, wherein the single phase is a face-centered cubic phase.

5. The primary alloy of claim 1, wherein the primary alloy is an annealed alloy.

6. The primary alloy of claim 1, wherein the electrical conductivity is produced from quenching an annealing alloy from an annealing temperature at a cooling rate effective to produce the primary alloy in the disordered crystalline phase.

7. The primary alloy of claim 6, wherein the cooling rate is greater than or equal to air cooling from the annealing temperature to room temperature.

8. The primary alloy of claim 1, wherein a yield strength of the primary alloy is from 130 MPa to 160 MPa.

9. The primary alloy of claim 1, wherein a hardness of the primary alloy is from 80 VHN to 110 VHN.

10. The primary alloy of claim 1, wherein the electrical conductivity is selected such that a coin comprising the primary alloy is acceptable as currency in a vending machine that accepts the coin.

11. A coin comprising the primary alloy of claim 1.

12. A process for making the primary alloy of claim 1, the process comprising:

heating a secondary alloy to a first temperature that is greater than or equal to an annealing temperature to form an annealing alloy, the secondary alloy comprising a secondary phase; and quenching, by cooling the annealing alloy from the first temperature to a second temperature that is less than the annealing temperature, under a condition effective to form the primary alloy of claim 1 comprising the disordered crystalline phase, wherein the disordered crystalline phase is different than the secondary phase of the secondary alloy.

13. The process of claim 12, further comprising:

melting a composition comprising the nickel, copper, and zinc to form a molten alloy; and casting the molten alloy to form the secondary alloy in a solid state comprising the secondary phase, wherein the annealing temperature is from 700° to 800° C.; and the condition comprises a cooling rate that is greater than or equal to air cooling from the first temperature to the second temperature.

* * * * *